US008450682B2

(12) United States Patent
Hiraoka

(10) Patent No.: US 8,450,682 B2
(45) Date of Patent: May 28, 2013

(54) IONIZATION METHOD AND APPARATUS USING A PROBE, AND ANALYTICAL METHOD AND APPARATUS

(75) Inventor: Kenzo Hiraoka, Kofu (JP)

(73) Assignee: University of Yamanashi, Kofu-Shi (JP)

( * ) Notice: Subject to any disclaimer, the term of this patent is extended or adjusted under 35 U.S.C. 154(b) by 88 days.

(21) Appl. No.: 13/125,437

(22) PCT Filed: Oct. 19, 2009

(86) PCT No.: PCT/JP2009/068294
§ 371 (c)(1),
(2), (4) Date: Apr. 21, 2011

(87) PCT Pub. No.: WO2010/047399
PCT Pub. Date: Apr. 29, 2010

(65) Prior Publication Data

US 2011/0198495 A1 Aug. 18, 2011

(30) Foreign Application Priority Data

Oct. 22, 2008 (JP) ..... 2008-271954

(51) Int. Cl.
*H01J 49/10* (2006.01)

(52) U.S. Cl.
USPC ..... 250/288; 250/423 R

(58) Field of Classification Search
USPC ..... 250/288, 423 R
See application file for complete search history.

(56) References Cited

U.S. PATENT DOCUMENTS

| | | | | |
|---|---|---|---|---|
| 5,945,678 | A | 8/1999 | Yanagisawa | |
| 7,335,897 | B2 * | 2/2008 | Takats et al. | 250/425 |
| 7,902,499 | B2 * | 3/2011 | Hiraoka et al. | 250/282 |
| 8,253,098 | B2 * | 8/2012 | Hiraoka et al. | 250/288 |

FOREIGN PATENT DOCUMENTS

| | | | |
|---|---|---|---|
| EP | 1 806 572 | A1 | 7/2007 |
| EP | 2 017 610 | A1 | 1/2009 |
| JP | 10-112279 | A | 4/1998 |
| JP | 2004-191262 | A | 7/2004 |
| JP | 2005-98909 | A | 4/2005 |

(Continued)

OTHER PUBLICATIONS

Altelaar et al., "Direct Molecular Imaging of Lymnaea stagnalis Nervous Tissue at Subcellular Spatial Resolution by Mass Spectrometry", Analytical Chemistry, Feb. 1, 2005, vol. 77, No. 3, pp. 735-741.

(Continued)

*Primary Examiner* — Kiet T Nguyen
(74) *Attorney, Agent, or Firm* — Birch, Stewart, Kolasch & Birch, LLP

(57) ABSTRACT

The tip of an electrically conductive probe 11 is brought into contact with a sample and captures the sample S under atmospheric pressure, a high voltage for electrospray is applied to the probe 11 while a solvent is supplied to the tip of the probe 11 that has captured the sample, and molecules of the sample S at the probe tip are ionized. A miniscule amount of a fine solvent droplet is supplied to the probe tip and slow electrospray is implemented. As a result, the size of the electrically charged droplet can be made extremely small and components within the sample can be analyzed extensively without selectivity. Further, in imaging over an extended period of time, electrospray is possible even in the event that the sample dries.

20 Claims, 10 Drawing Sheets

FOREIGN PATENT DOCUMENTS

| | | | |
|---|---|---|---|
| JP | 2006-125984 | A | 5/2006 |
| JP | 2008-209544 | A | 9/2008 |
| WO | WO 2007/126141 | A1 | 11/2007 |

OTHER PUBLICATIONS

Chaurand et al., "Imaging mass spectrometry: a new tool to investigate the spatial organization of peptides and proteins in mammalian tissue sections", Current Opinion in Chemical Biology, Oct. 2002, vol. 6, No. 5, pp. 676-681.

Chen et al. "Application of probe electrospray to direct ambient analysis of biological samples", Rapid Communications in Mass Spectrometry, Jul. 11, 2008 vol. 22, No. 15, pp. 2366-2374.

Chen et al., "Characteristics of Probe Electrospray Generated from a Solid Needle", Journal of Physical Chemistry B., Aug. 12, 2008; vol. 112, No. 35, pp. 11164-11170.

International Search Report, PCT/JP2009/068294, Nov. 17, 2009.

* cited by examiner

IONIZATION METHOD AND APPARATUS USING A PROBE, AND ANALYTICAL METHOD AND APPARATUS

TECHNICAL FIELD

The present invention relates to an ionization method and apparatus using a probe and relying on electrospray in particular, and to an ionization analyzing method and apparatus.

BACKGROUND ART

Broadly speaking, there are two categories of imaging mass spectrometry for dealing with biological samples and industrial products and the like. The first is matrix-assisted laser desorption ionization (MALDI), and the second is secondary ion mass spectrometry (SIMS). These methods are described in the following literature, by way of example:

"Imaging mass spectrometry: a new tool to investigate the spatial organization of peptides and proteins in mammalian tissue sections", Current Opinion in Chemical Biology 2002, 6, 676-681, and "Direct molecular imaging of Lymnaea stagnalis nervous tissue at subcellular spatial resolution by mass spectrometry", Anal. Chem. 2005, 77, 735-741.

To mention one example of a method of sample preparation by MALDI, a biological sample is cooled to −18° C. and a 15-μm section (piece) of the biological sample is produced as by using a stainless steel blade. The section is placed on an electrically conductive film and the sample is then dried. The sample surface is thinly coated with a matrix to thereby obtain a MALDI sample, the sample is inserted into a vacuum chamber and MALDI is carried out. There is also a method (laser capture microdissection) in which a biological sample is placed upon a polyethylene film and the macromolecular film is heated momentarily by irradiating it with a laser beam from the back side of the film, thereby transferring the cells at the contact interface to the film. Primarily, a 337-nm nitrogen laser is used in the desorption ionization of the sample ions.

It is difficult to reduce the beam diameter of the laser beam to less than several tens of microns with these methods, and since aberration extends over a wide area, the limit on spatial resolution is 50 μm. Further, by using a matrix, which is the most distinctive feature of MALDI, ion detection sensitivity increases markedly. On the other hand, however, spatial resolution is limited since the crystal size of the matrix applied to the sample exceeds 100 μm.

With the SIMS method, a metal ion source ($Ga^+$, $Au^+$, etc.) that approximates a point light source is employed and a spatial resolution of less than a micron is attained. However, the energy of the ions is large (10 to 20 keV), incident ions penetrate into the sample over a depth of several hundred angstroms and the sample sustains damage. Consequently, the yield of ions from a readily decomposed sample such as a biological sample declines rapidly with time. Since the sample desorbed is limited to the molecules in the proximity of the surface, the detection sensitivity of ions with respect to biologically related samples is low.

Cluster SIMS has been developed for the purpose of eliminating this drawback. It has become evident that the desorption efficiency of secondary ions increases sharply if gold cluster ions ($Au_n^+$) or $C60^+$ ions, for example, are used as the incident ions.

However, a spatial resolution of less than a micron is difficult to obtain because the current of the primary ion beam is small and the ion beam diameter is greater than several microns. These SIMS methods are all difficult to apply to high-mass molecules such as biological macromolecules.

Imaging techniques using MALDI and SIMS of the kind described above are continuing to come into widespread use in the field of life science. With these methods, however, it is difficult to obtain a resolution of less than a micron owing to the fundamental limitations thereof. Accordingly, no matter what improvements are applied to the conventional MALDI and SIMS methods, it is difficult to realize a resolution of less than a micron so long as these are adopted as the basic techniques.

On the other hand, with conventional electrospray or nanolaser spray, a sample liquid forms a conical shape (referred to as a "Taylor cone") at the tip of a capillary and a minute charged droplet is produced from the conical tip. Owing to the viscosity of the liquid, it is fundamentally impossible to impart this droplet with a size of less than a micrometer or submicrometer. The reason for this is that when the tip of the Taylor cone is torn off by the force of the electric field to produce the droplet, the diameter of the tip of the Taylor cone takes on the submicrometer size automatically owing to the viscosity of the liquid. Thus, droplet size capable of being produced by electrospray is decided in the manner of a natural occurrence and it is difficult to achieve a further reduction in size.

Further, with conventional electrospray, achieving the nanometer level (nanoelectrospray) is accompanied by the need to reduce capillary diameter. There are many limitations such as clogging. It is difficult to produce a spray and handling is troublesome. Furthermore, with conventional electrospray, an increase in salt concentration results in spraying difficulty and there is a sudden decline in desorption efficiency of ions into the gaseous phase. Accordingly, conventional electrospray cannot be applied to NaCl aqueous solutions on the order of 150 mM, such as physiological saline solution.

DISCLOSURE OF THE INVENTION

The present invention provides an ionization method and apparatus in which biological tissue and the like without pre-treatment can be adopted as a sample of interest and, moreover, it is possible to desorb and ionize the sample ions under atmospheric pressure.

Further, the present invention provides a method and apparatus in which a miniscule sample can be handled without causing clogging and the like and, moreover, it is possible to produce an electrospray efficiently.

Further, the present invention provides a method and apparatus capable of producing the electrospray phenomenon even with regard to a liquid biological sample and sample having a high salt concentration.

Further, the present invention provides an ionization method and apparatus in which imaging having a resolution on the nanometer (nm) order is possible.

Further, the present invention enables the desorption and ionization of sample molecules to be carried out even if the sample dries because it takes an extended period of time to perform imaging in sample analysis.

Further, the present invention makes it possible to perform ionization and analysis effectively by using the full amount of a sample.

Further, the present invention arranges it so that efficient sample ionization and desorption take place simultaneously.

Further, the present invention provides a method of ionizing a sample in which highly sensitive analysis is possible.

Further, the present invention provides a mass spectrometry method and apparatus using the above-mentioned ionization method and apparatus.

An ionization method according to the present invention comprises bringing the tip of an electrically conductive probe into contact with a sample and capturing the sample at the tip of the probe [here this includes capturing the sample by causing the tip of the probe to penetrate (slightly) into the interior of the sample]; and applying a high voltage for electrospray to the probe while supplying a solvent to the tip of the probe, which has captured the sample and separated from the sample, thereby ionizing molecules of the sample at the tip of the probe.

An ionization apparatus according to the present invention comprises a probe; a sample stage for holding a sample; a displacing unit for moving at least one of the probe and sample stage in a direction in which these approach and separate from each other; a power supply unit for applying a high voltage to the probe at a position where at least the tip of the probe is spaced away from the sample stage; and a solvent supply unit for supplying a solvent to the tip of the probe at a position where at least the tip of the probe is spaced away from the sample stage.

If the solvent is one that dissolves or wets the sample, any solvent may be used, and it may be in the form of a liquid or gas. Examples of the solvent are water, alcohol, acetic acid, trifluoroacetic acid, acetonitrile, an aqueous solution, a mixed solvent or a mixed gas, etc. These solvents can be supplied to the tip of the probe as is in the form of a liquid or upon being converted to a mist or heated vapor or in the form of a gas.

It may be so arranged that the solvent is supplied constantly at a position spaced away from the sample during measurement or analysis so that the solvent can be supplied to the probe tip that has arrived at this position. This simplifies control of supply of the solvent. It may be so arranged that the solvent is supplied to the probe tip only when the probe has arrived at the position spaced away from the sample. Although the sample may be solid or liquid, supply of the solvent is particularly important in cases where the sample is a solid.

It can be so arranged that the sample is placed at a floating potential and an electrospray voltage is applied to the probe constantly during measurement or analysis. This simplifies control of application of high voltage. Naturally, a pulsed high voltage may be impressed across the probe and an ion introduction path after the probe is spaced away from the sample.

By bringing the probe into contact with the sample, the probe and sample take on the same potential at least during the time that the probe is in contact with the sample. An operation or means for positively bringing these to the same potential, therefore, need not necessarily be devised (the sample may be allowed to float electrically). Naturally, the probe and sample (a sample table on which the sample is placed, or a capillary that supplies the liquid sample, for example) may be connected to forcibly bring them to the same potential.

In accordance with the present invention, a DC high voltage for electrospray is applied to the probe, while the tip of the probe is supplied with the solvent, at a position where the tip of the electrically conductive probe has been spaced away from the sample upon capturing the sample. The molecules of the sample, therefore, are desorbed from the sample and ionized by electrospray. Further, owing to supply of the solvent, desorption and ionization by electrospray are promoted even in a case where the sample dries or, as in a biological sample, component concentration is high. Furthermore, by supplying a miniscule amount of solvent, slow electrospray is realized and components within the sample can be analyzed extensively without selectivity.

In accordance with the present invention, it is unnecessary to place the probe or sample inside a vacuum chamber, and ionization can be performed under atmospheric pressure (in the atmosphere, in another inert gas or in a saturated vapor-pressure chamber, etc.). The sample can be used as is without applying a pre-treatment. It is possible to use a biological sample as the sample.

In accordance with the present invention, the sample is captured at the tip of the probe and is then subjected to electrospray. Since a probe is used, clogging does not occur. If a probe having a sharp tip is used, an electrospray can be produced efficiently (the effect of the electric field is enhanced to the limit). If a probe having a tip diameter on the atomic level is used, then a nanometer level for the diameter of the needle tip can be achieved to the maximum degree. As a result, the electrospray phenomenon can be produced even for samples having a high salt concentration.

In an embodiment of the ionization method, the probe is made to approach in the direction of the sample, the probe is brought into contact with the sample surface and the probe is made to penetrate a prescribed depth into the sample where the probe contacted the sample surface.

In an embodiment of the ionization apparatus, the apparatus further comprises a contact detecting unit for detecting that the probe tip has contacted the surface of the sample on the sample stage. The displacing unit causes the probe to approach relatively in the direction of the sample stage and, when the fact that the probe tip has contacted the surface of the sample on the stage is detected by the contact detecting unit, displaces the probe from the detected position so as to cause the probe to penetrate into the sample to a prescribed depth.

Even if the surface of the sample is uneven, the fact that the probe has contacted the surface of the sample is detected and the probe is caused to penetrate the sample to a fixed depth from the position where surface contact is detected. This makes it possible to sample the portion of the sample of the fixed depth at all times.

In the case of a solid sample that contains liquid, such as a biological sample, imaging in particular is possible. That is, if the size of the probe tip is made on the order of nanometers and the minimum unit of amount of displacement when the probe is displaced along the sample surface is controlled on the nm order, then the sample molecules can be captured by the probe with a resolution on the nm order. Accordingly, it will be possible to measure (to image two-dimensionally) the distribution of molecules on the sample surface on the order of nanometers. If the sample is captured not only at a position at a fixed depth from the sample surface but also at various positions along the depth direction, then three-dimensional imaging is possible. Such imaging takes time since sample collection is performed at a number of points, and the sample may dry out. In accordance with the present invention, even in such case it is possible to continue reliable measurement and analysis of the sample by supplying the solvent.

In an embodiment of the present invention, the surface of the probe tip can be chemically modified by molecules that capture a desired compound before the sample is captured. As a result, specific molecules in the sample can be captured selectively.

In another embodiment of the present invention, a laser device for irradiating the vicinity of the probe tip with laser light (ultraviolet, infrared or visible light) is provided, and the vicinity of the probe tip at the position spaced away from the sample or a position somewhat removed from the tip (a spaced-away position beneath the tip) is irradiated with the laser beam. As a result, desorption ionization of the sample molecules by electrospray is augmented.

Another ionization method according to the present invention comprises in-vacuo cooling of at least the tip of an electrically conductive probe that has captured a sample at the tip thereof; spraying a solvent gas toward the cooled tip of the probe and causing the solvent gas to be adsorbed; and subsequently applying a high voltage for electrospray to the probe to thereby ionize molecules of the sample at the tip of the probe.

The solvent gas adsorbed on the probe permeates a biological sample that has been captured on the probe surface and increases the fluidity of the biological sample. If a DC high voltage for electrospray is applied to the probe in this state, a high DC electric field is produced at the tip of the probe. Owing to the fact that the adsorbed gas moistens the sample, the sample develops fluidity, the sample in the liquid state is transported toward the probe tip by the action of the high electric field and electrospray is produced from the tip. Molecules inside the sample are ionized by the electrospray. Since electrospray is carried out in a vacuum, the efficiency with which ions are transported toward a mass spectrometer is extremely high in comparison with atmospheric-pressure electrospray, and this leads to higher sensitivity.

In a preferred embodiment, the cooled probe, in a state in which a DC high voltage is applied thereto, is irradiated with infrared laser light, ultraviolet laser light or visible laser light, and the sample that has been captured at the tip of the probe is desorbed and ionized. Owing to the irradiation with infrared laser light (oscillatory excitation of the solvent molecules) or irradiation with the ultraviolet or visible laser light, the adsorbed or frozen solvent solid melts, thereby increasing the fluidity thereof, the sample molecules are transported toward the probe tip while the sample molecules, which have been captured at the probe tip, are dissolved, and the sample molecules are ionized by the electrospray phenomenon at the probe tip, whereby the molecules are desorbed (sprayed) toward the vacuum. Further, this has the effect of promoting desorption and ionization owing to plasmons induced on the laser-irradiated metal surface.

The present invention also provides an analytical method and apparatus for mass spectrometry of a sample ionized by all of the above-described ionization methods or ionization apparatuses.

The present invention further provides an ionization method comprising coating the surface of the tip of an electrically conductive probe with a matrix; bringing the probe tip coated with the matrix into contact with a sample and capturing the sample [here this includes capturing the sample by causing the tip of the probe to penetrate (slightly) into the interior of the sample]; and irradiating the tip of the probe, which has captured the sample, with laser light of a wavelength absorbed by the matrix and applying a high voltage for electrospray to the probe to thereby desorb and ionize molecules of the sample at the tip of the probe.

When the tip of the probe to which a DC high voltage is being applied is irradiated with a laser, the matrix attains a molten state, dissolving/mixing with the sample is brought about and a spray, which is a combination of matrix-assisted laser desorption ionization and electrospray, is produced from the probe tip. As a result, highly efficient sample ionization and desorption occur simultaneously. This method may be carried out under atmospheric pressure or in vacuum.

The present invention further provides an ionization method comprising holding a probe in such a manner that it is reciprocatable between a bottom end point where the tip of the probe contacts a sample [here the bottom end point is inclusive of a position where the tip of the probe has penetrated (slightly) into the interior of the sample] and a top end point where the tip of the probe separates from the sample; placing an ion introduction path, which introduces sample ions to an analytical apparatus, in such a manner that an end of the ion introduction path is situated in the vicinity of the probe tip in the neighborhood of the top end point; moving the probe toward the bottom end point and bringing the probe tip into contact with the sample to thereby capture the sample; and impressing a high voltage for electrospray across the probe and ion introduction path constantly. While the probe is in contact with the sample, the probe and sample are held at the same potential by this contact. When the probe is subsequently moved toward the top end point, a high voltage for electrospray is impressed across the probe and the ion introduction path when the probe separates from the sample. As a result, the sample that has been captured at the probe tip is ionized.

Since a DC high voltage for electrospray is applied constantly, control of same is simplified.

BEST MODE FOR CARRYING OUT THE INVENTION

First Embodiment

Figure 1:
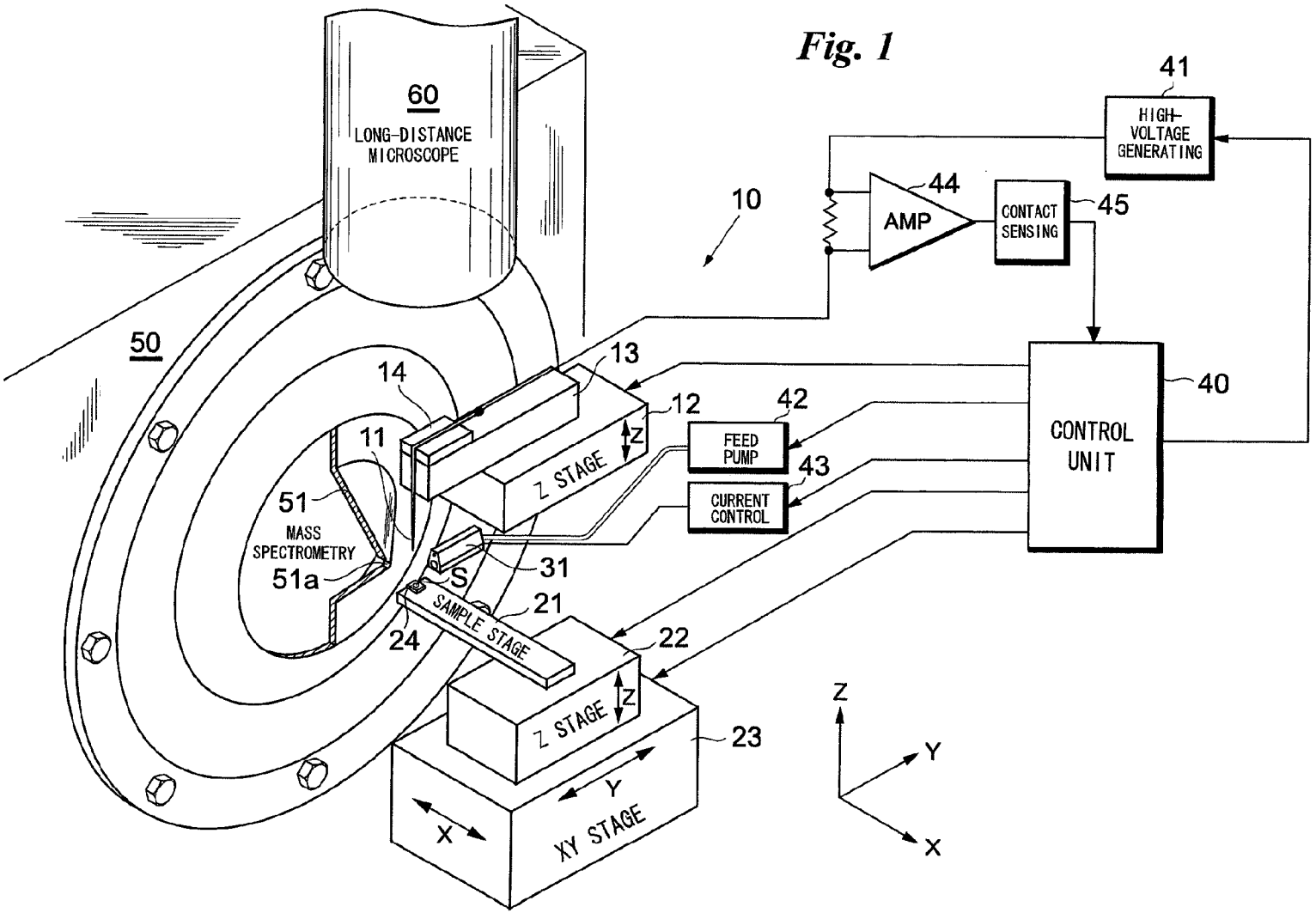
FIG. 1 illustrates the overall configuration of an ionization apparatus and ionization analyzing apparatus (analytical apparatus) according to a first embodiment.

FIG. 1 illustrates the configuration of an ionization apparatus and ionization analyzing apparatus capable of imaging according to a first embodiment.

The ionization analyzing apparatus comprises an ionization apparatus 10 and a mass spectrometry apparatus (ion analyzing apparatus) 50.

Sample ions desorbed and ionized from a sample by the ionization apparatus 10 are introduced to the mass spectrometry apparatus 50. Although an (orthogonal) time-of-flight mass spectrometer can be mentioned as an example of the mass spectrometry apparatus, the present invention is also applicable to a mass spectrometry apparatus such as a (linear) ion-trapping mass spectrometry apparatus, a quadrupole mass spectrometry apparatus and a Fourier transform mass spectrometry apparatus. The interior of the mass spectrometry apparatus 50 is held in vacuum. The mass spectrometry apparatus 50 is equipped with a skimmer (orifice) 51 for ion sampling, the tip of the skimmer has an ion introduction hole (ion introduction path) 51*a*, and the interior of the mass spectrometry apparatus 50 is connected by the ion introduction hole 51*a* to the outside world (atmospheric pressure) in which the ionization apparatus 10 has been placed. Also available is an analytical apparatus having an ion sampling capillary rather than a skimmer as the ion introduction path. Depending upon the type of mass spectrometry apparatus, there is one in which an ion focusing voltage (a comparatively low voltage of less than +100 V in case of a positive ion mode and less than −100 V in case of a negative ion mode) is applied to the ion sampling capillary (orifice) by a power supply unit. There are also cases where the ion sampling capillary is grounded. The outer wall of the mass spectrometry apparatus 50 generally is grounded.

The ionization apparatus 10 includes an electrically conductive probe 11; a Z stage (device) 12 for supporting and driving (along the Z direction) the probe 11; a sample stage 21 holding a sample S; a Z stage (device) 22 for driving the sample stage 21 (sample S) along the Z direction; an XY stage (device) 23 for driving the sample stage along the XY directions; a heating capillary unit (solvent supply unit) 31 for supplying a solvent; a high-voltage generating unit 41 which generates a DC high voltage for electrospray applied to the probe 11; a contact sensing circuit 45 for detecting that the probe 11 has contacted the surface of the sample S on the sample stage 21; and a control unit 40 for controlling each of these devices. Ionization of the sample is carried out under atmospheric pressure.

Here "drive" means moving (displacing) the probe 11 or sample S along the X, Y or Z direction. The direction in which the tip of the probe 11 points (the up-and-down direction in FIG. 1) (the direction along which the probe is displaced) is the Z direction, and the two directions orthogonal to the Z direction are the X and Y directions. The Z stages 12, 22 construct a displacing unit for moving at least one of the probe 11 and sample stage 21 in a direction (the Z direction) in which these approach and separate from each other. The displacing unit can also be implemented by either one of the Z stages 12, 22. The XY stage 23 moves the sample S in the XY plane (in the plane on which the sample is placed on the sample stage 21) in order to perform two-dimensional imaging of the sample. The sampling of the sample S may be performed once (a single up-and-down reciprocation of the probe 11) or twice or more per one location in the XY plane. In this embodiment, the Z stage 22 is supported on the XY stage 23, and the Z stage 22 is provided with the sample stage 21. The sample stage 21 extends in the direction of the mass spectrometry apparatus 50 and a substrate 24 on which the sample S has been placed is secured to the tip thereof.

A support member 13 is provided on the Z stage 12, and the probe 11 is secured on the support member 13 via an insulator 14. The probe 11 in this embodiment has been bent at a right angle and placed in such a manner that the tip thereof points vertically downward (the Z direction).

Preferably, these driving units 12, 22, 23 include a device having a movement function exhibiting good mechanical reproducibility, such as a piezoelectric element or a motor-driven or magnetically driven device, and can control the amount of displacement on the nm order along each of the directions. In particular, it is preferred that the unit 12, which reciprocates the probe 11 in the longitudinal direction, be such that the frequency, amplitude and number of oscillations of reciprocation (in which an oscillation includes a single reciprocation) can be controlled.

When the probe 11 is situated at its highest point (this position will be referred to as the "top end point") in its up-and-down motion within the limits of its measurement operation, the tip of the probe 11 is in the vicinity in front of the ion introduction hole 51*a* of the skimmer 51 of mass spectrometry apparatus 50, and a pre-adjustment is made in such a manner that the probe tip will be situated at the same height as or slightly higher than the ion introduction hole 51*a*. At this position the molecules of the sample captured at the tip of the probe 11 are ionized and introduced into the analytical apparatus 50 from the ion introduction hole 51*a*. The sample S is situated directly beneath the tip of the probe 11.

A DC high voltage on the order of several kV for electrospray is applied across the ion sampling skimmer 51 and probe 11 by the high-voltage generating unit 41. The potential of the probe 11 is a positive potential (in case of a positive-ion measurement mode) or a negative potential (in case of a negative-ion measurement mode). In a case where the sample S (and substrate 24 and, if necessary, the sample stage 21) has an insulating property (the sample S is floating electrically), the above-mentioned DC high voltage can be applied constantly during the measurement operation. In this case, the probe 11 and sample S take on the same potential when the probe 11 contacts the sample S (inclusive also of when the probe 11 is penetrating into the interior of the sample S). Since the DC high voltage is being applied across the probe 11 and skimmer 51, when the probe 11 departs from the sample S (with some of the sample having been captured at the tip of the probe 11) and the probe tip approaches the ion introduction hole 51*a*, the electric field strength of the probe tip increases and electrospray is produced from the probe tip that has arrived in the vicinity of the ion introduction hole 51*a*.

When the probe 11 contacts the surface of the sample S under the above conditions, a very weak signal appears at a resistor (a high resistance body) connected across the output side of the high-voltage generating unit 41 and the probe 11. The reason for this is that it is considered that the probe 11 forms part of a capacitor together with the ground and it is inferred that a slight change in this capacitance is produced by contact with the sample S. The above-mentioned weak signal is sensed by the contact sensing circuit 45, which applies a signal to the control unit 40. This signal has the frequency of a commercial power supply supplied to the high-voltage generating unit 41, for example, and, after being amplified by an amplifier 44, is extracted by a filter within the contact sensing circuit 45 and then sensed by level discrimination.

Figure 2:
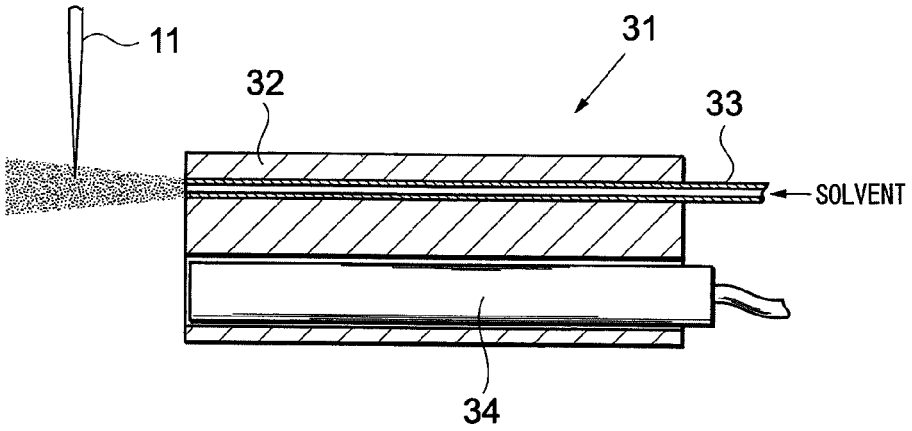
FIG. 2 is a sectional view illustrating an example of the configuration of a heating capillary device (solvent supply unit)

An example of the configuration of the heating capillary unit (solvent supply unit) 31 is illustrated in FIG. 2. The unit 31 includes a block 32 (made of a ceramic or metal) through the interior of which a solvent feed capillary 33 passes and is provided with a heater (pencil heater) 34. A solvent is supplied to the capillary 33 from a feed pump 42 and is heated by the heater 34 so that a high-temperature vapor of the solvent is sprayed from the tip of the capillary 33. The unit 31 is positioned and supported (the support body is not shown) in such a manner that the solvent vapor will strike the tip of the probe 11 situated at the top end point. The heating current to the heater 34 is controlled by a current control unit 43 in such a manner that the heater 34 will take on the desired (prescribed) temperature.

As for the solvent, any will suffice in accordance with the type of sample so long as it dissolves or wets the sample, examples being water, alcohol (methanol, ethanol, etc.), acetonitrile, various aqueous solutions and various mixed solvents.

Figure 5:
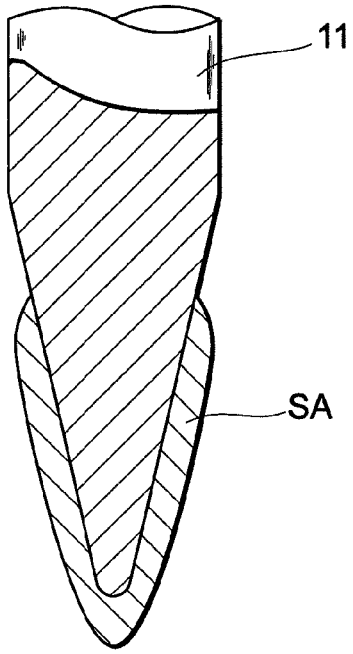
FIG. 5 illustrates the manner in which a sample has been captured at the tip of a probe.

A microscope [an optical microscope, long-distance microscope, scanning probe microscope (SPM) or scanning-type tunnel microscope, etc.] 60, which is for observing a state in which the sample (a biological sample, etc.) S is made to contact the tip of the probe 11 and the sample is captured upon being pierced slightly), need not necessarily be provided. As illustrated in FIG. 5, for example, a miniscule amount of the sample (indicated by characters SA) is captured at the tip of the probe 11. The tip diameter of the probe 11 is on the micron order or less (the nanometer order).

It is preferred that a DC high voltage be applied to the probe 11 constantly, as mentioned above. Although an example of detailed operation will be described later, an overview is as follows:

The probe 11 is lowered and brought into contact with a desired location on the sample S (this also includes penetration of the tip of the probe 11 into the sample) so that the sample is captured (sampled) at the tip of the probe 11. The probe 11 and sample S are at the same potential while the probe 11 is in contact with the sample S. The probe 11 is subsequently moved upward. When the probe 11 separates from the sample S and approaches the ion introduction hole 51*a*, electrospray is produced from the tip of the probe 11 owing to a potential difference applied across the probe 11 and the ion sampling skimmer 51 of the mass spectrometry apparatus 50, and the molecules of the sample S that was captured at the tip of the probe 11 are desorbed in the gaseous phase and ionized. The sample ions thus generated are drawn in from the ion introduction hole 51*a* of the ion sampling skimmer 51 and are introduced into the mass spectrometry apparatus 50.

Since the probe 11 and sample S are always at the same potential in this embodiment, electrospray from the probe 11 toward the sample S is not produced. When the probe 11 separates from the sample S and approaches the ion introduction hole 51*a*, the electric field strength of the probe tip increases and electrospray is produced from the tip of the probe 11 toward the ion sampling skimmer 51. In this case, since the distance between the tip of the probe 11 and the tip of the ion sampling skimmer 51 can be reduced to less than several millimeters, the ions generated by electrospray can be introduced into the mass spectrometry apparatus 50 efficiently.

The up-and-down motion of the probe 11 and the up-and-down motion of the sample S can be achieved by the Z stage 12 and Z stage 22, respectively, and the probe 11 may be made to penetrate the sample S one time or several times per location on the surface of the sample S. In the latter case, the penetration depth (position along the Z axis) may be changed. By incrementally changing the surface position (positions along the X and Y directions) of sample S, where it is penetrated by the probe 11, by the XY stage 23, it is possible to perform imaging of the surface of sample S.

Throughput of analysis can be raised by providing a probe support base (not shown) beforehand with a number of probes (multiple probes) and performing sampling simultaneously from a number of locations on the sample surface. The surface of the tip of probe 11 may be roughened in order to improve the efficiency of sample retention (collection and capture). (For example, grooves such as threads may be cut into the tip of probe 11.)

As illustrated in FIG. 2, the sample SA is captured and, while the tip of the probe 11 that has arrived in the vicinity of the top end point is supplied continuously with the high-temperature vapor of the solvent by the heating capillary unit 31, the DC high voltage is applied to the probe 11 to thereby produce electrospray. In this way the sample S that has been captured at the probe tip is electrosprayed slowly (e.g., for from several hundred milliseconds to several seconds). As a result, the molecules of the overall sample are ionized, led to the mass spectrometry apparatus and analyzed.

Supplying a solvent is technically significant in several ways.

In general, a biological sample comprises many components. Hence there are cases where, when electrospray is produced immediately by applying high voltage to a probe that has captured a sample, hydrophobic components that are readily electrosprayed are electrosprayed selectively while hydrophilic components remain on the probe. In order to detect all components of biological components extensively, the probe tip is supplied with a miniscule amount of a fine solvent droplet and slow electrospray is implemented. As a result, the charged droplet is rendered miniscule in size and the components in the sample are electrosprayed successively, from components that are easily electrosprayed to those that are not, without selectivity. All components, therefore, can be analyzed. That is, a sample that has taken on the liquid state is electrosprayed from the probe tip while the sample is dissolved (imparted with fluidity).

Owing to the supply of solvent, the liquid solvent flows on the surface while dissolving the sample on the probe surface, and electrospray is produced from the probe tip. Since the size of the charged droplet produced is on the order of several tens of nanometers or less, sample ions that can exist within a single droplet are less than a single-molecule ion (one). Consequently, all molecule ions in the sample are detected and ion detection efficiency is raised to the limit.

In general, electrospray is highly sensitive and a sample amount of less than a picoliter captured at the probe tip affords an adequate ion signal. In order to use the full amount of the sample and perform analysis effectively, it is necessary to electrospray the sample slowly. What satisfies this requirement is the technique of this embodiment. The diameter of the probe tip preferably is several tens to several hundred nanometers, and this decides the spatial resolution. That is, a single cell (the diameter of which is on the order of 10 μm) can be a sufficient measurement target. As a result, a spatial resolution of less than 1 μm can be attained. In molecular imaging measurement, a technique having a spatial resolution of less than a micron is realized.

If sampling at a number of points (e.g., 300 points within a range on the order of 1 $mm^2$) is performed in such molecular imaging measurement, this will take a very long period of time (several hours, for example). The sample, therefore, will dry out. Ions will not be electrosprayed in the case of a dry sample. However, if a (high-temperature) vapor of the sample is sprayed toward the probe tip, the sample will be ionized and electrosprayed.

The high-temperature solvent vapor (the temperature differs depending upon the sample; in the case of water, the range is about 120° C. to 140° C.) is sprayed toward the probe tip weakly (softly). High-temperature water vapor condenses on the room-temperature probe. As described above, water is supplied from the feed pump 42 to the heating capillary unit 31, is heated by the heater 34 to produce water vapor, and the heated water vapor is sprayed constantly from the heating capillary unit 31.

The probe 11 reciprocates between the top end point and the bottom end point (which may be the position where it contacts the surface of the sample S or the position where it penetrated into the sample S). When the probe 11 arrives at the top end point, it is positioned in such a manner that the high-temperature water vapor strikes its tip. When the probe 11 reaches the bottom end point, the high-temperature water vapor strikes a location somewhat above the tip of the probe but this does not pose a problem. As one example, the solvent supplied has a flow rate of several microliters/minute if expressed in terms of water and, if expressed in terms of water vapor, a flow rate which is approximately 1000 times greater, namely about several milliliters/minute.

Thus, supply of a solvent vapor is particularly efficacious with regard to a semi-dry solid sample that does not have much water content.

Figure 6A:
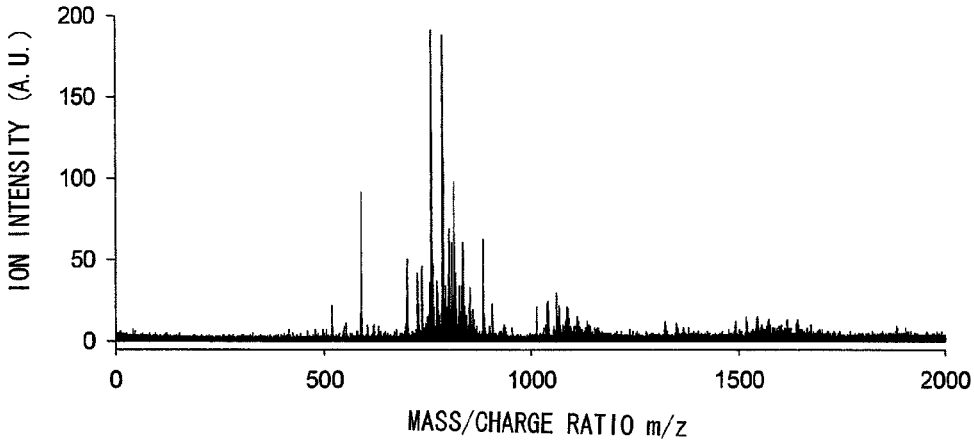
FIG. 6 are mass spectra (graphs) illustrating results of mass spectroscopy based upon ionization, in which FIG. **6*a* is a case where adequate solvent vapor has been supplied, FIG. 6*b* a case where supply of solvent vapor has been reduced, and FIG. 6*c*** a case where no solvent vapor is supplied.
Figure 6B:
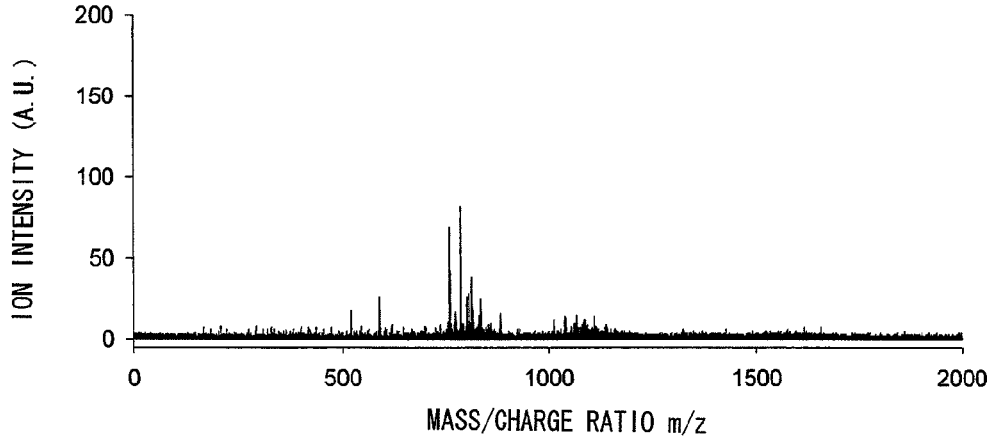
Figure 6C:
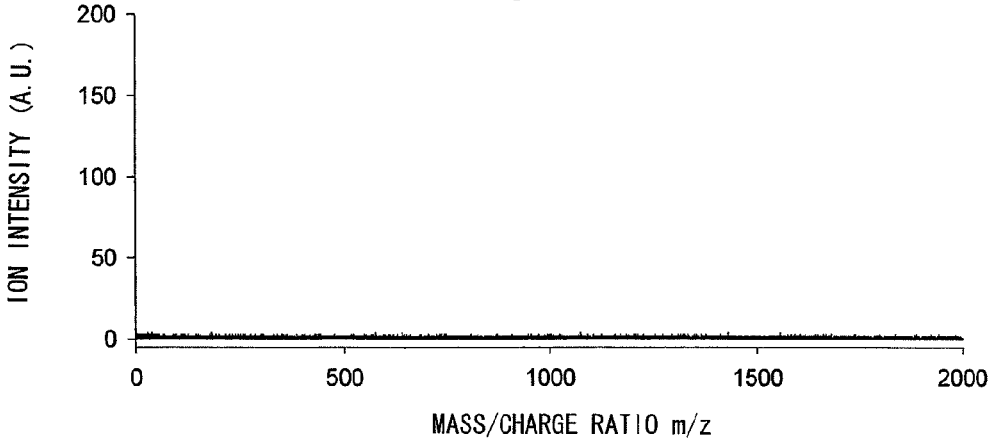

FIGS. 6*a* to 6*c* a mass spectra (graphs) illustrating results of analysis by a mass spectrometry apparatus when the hippocampus of a mouse brain is used as the sample. FIG. 6*a* is a graph obtained when adequate high-temperature solvent vapor (where the solvent is water and the flow rate is several microliters/minute) is supplied and FIG. 6*b* a graph obtained when the amount of supplied high-temperature solvent vapor is reduced. FIG. 6*c* is a graph obtained when no solvent vapor is supplied; no ions whatsoever are detected. Thus, it will be understood that when the sample is in particular one in which drying has progressed, ions will be desorbed and ionized from the sample by supplying a solvent vapor.

Figure 4:
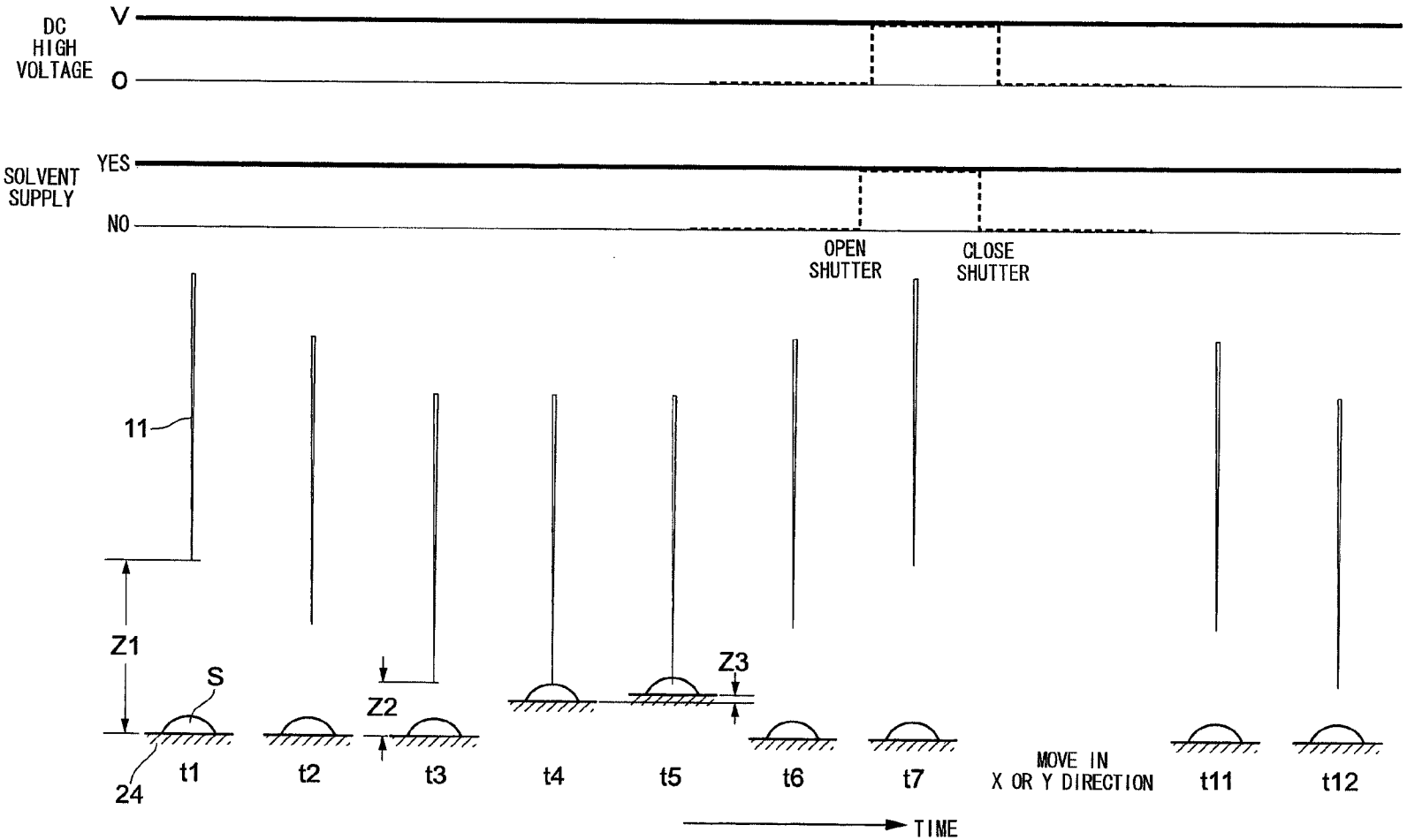
FIG. 4 is a time chart illustrating an example of control and operation of an ionization apparatus in the first embodiment.

In accordance with a predetermined program (the period of reciprocating motion of the probe 11, the up-and-down traveling distance of the probe 11, the piercing depth of the probe 11, the intervals of measurement points in two-dimensional imaging measurement, the flow rate of the solvent, the temperature of the solvent vapor and the value of DC high voltage, etc.), the control unit 40 responds to a contact detection signal from the contact sensing circuit 45 by performing a series of control operations of the kind shown in FIG. 4, namely control of the Z stages 12, 22, control of the XY stage 23, control of the heating capillary unit 31 and control of application of the DC high voltage.

An example of control by the control unit 40 will be described with reference to FIG. 4.

The probe 11 is situated at the top end point (time t1). Distance Z1 between the lower end of the probe 11 and the top surface of substrate 24 on which the sample S has been placed is from several millimeters to ten millimeters, by way of example.

The probe 11 is lowered to a position having a height of, e.g., 1 to 2 mm (indicated by Z2) from the top surface of substrate 24 and is stopped (in this embodiment, this position is the bottom end point) (time t2 and then time t3).

The sample stage 21 is subsequently raised by driving the Z stage 22 and a contact detection signal is output from the contact sensing circuit 45 (the tip of the probe contacts the surface of the sample (time t4), whereupon the sample stage is raised from this position by an amount equivalent to a fixed depth (the piercing depth of the probe 11, e.g., several microns to several hundred microns) (depth Z3) and is then stopped (time t5).

The surface of the sample S is uneven. If the substrate 24 is raised by the amount (Z3) equivalent to the fixed depth after the sample surface is detected (after surface contact is detected), therefore, the tip of the probe 11 will always reach the fixed depth from the sample surface and the portion of the sample at this position will be collected (sampled).

The probe 11 is then raised to the top end point and the sample S is lowered to the position at the original height (time t6 and then time t7).

The DC high voltage (indicated by V) is constantly being applied to the probe 11 and the high-temperature solvent vapor is constantly being supplied from the heating capillary unit 31. When the tip of the probe 11 leaves the sample S and the probe tip approaches the ion introduction hole 51*a*, electrospray generation starts. Since the solvent vapor is sprayed toward the tip of the probe 11 at a height position where the tip of the probe 11 has approached the top end point, the molecules of the sample are desorbed and ionized and an analytical result is obtained.

In the meantime or thereafter, the sample S is moved in position a very short distance along the X or Y direction (times t7 to t11).

The probe 11 is lowered again (times t11, t12), the probe 11 pierces the sample at a location shifted slightly from the location measured previously, this portion of the sample is collected and analysis is carried out in the same way based upon the desorption and ionization of the sample molecules. Thus, collection and analysis regarding many points are carried out within a fixed range of the sample S (this is two-dimensional imaging). If the piercing depth Z is changed at the same location or at different locations on the sample, three-dimensional imaging is possible as well.

In the time chart of FIG. 4, the DC high voltage V is applied to the probe 11 constantly (continuously). Further, the solvent vapor also is supplied constantly. When the probe 11 has been lowered, the solvent vapor is sprayed not toward the tip (the lowermost end) of the probe 11 but toward the upper portion thereof. Since the amount is miniscule, however, no impediment arises.

As another embodiment, after the probe 11 separates from the sample S and is raised a certain distance (is in the vicinity of the top end point), a high-voltage pulse may be applied across the ion sampling skimmer 51 and probe 11, as indicated by the dashed line in FIG. 4, to thereby produce electrospray at the tip of the probe 11. In this case it is preferred that both the probe 11 and sample S both be placed at the same potential so that a potential difference will not be produced across the probe and sample.

The supply of the solvent vapor may also be performed intermittently as indicated by the dashed line in FIG. 4. Preferably, the solvent is supplied slightly earlier than application of the high-voltage pulse. However, the timing of application of high voltage and supply of the solvent need not be controlled stringently and it will suffice if these are carried out substantially simultaneously.

Figure 3:
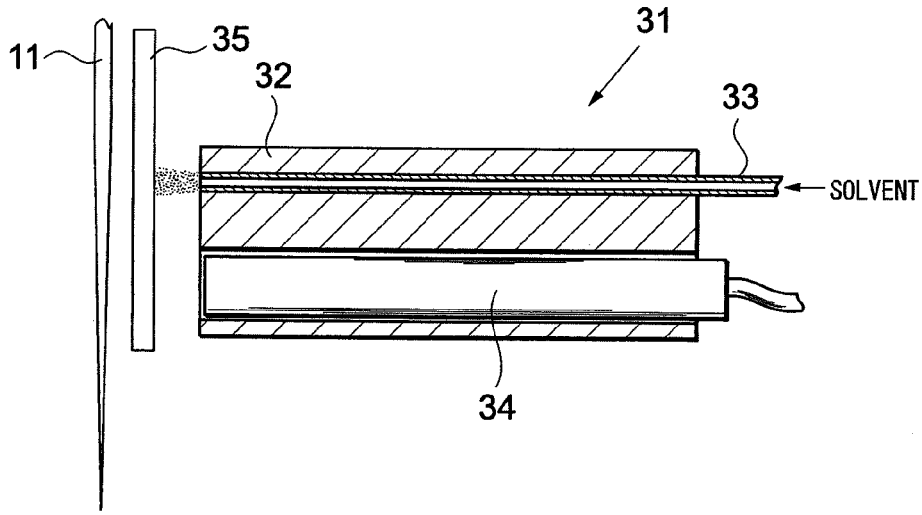
FIG. 3 is a sectional view illustrating an arrangement for controlling supply of solvent by providing a solvent supply unit with a shutter.

It will suffice if the intermittent supply of the solvent is performed by providing a shutter 35 freely movable (freely advanced and withdrawn) between the solvent vapor emission port of the heating capillary unit 31 and the probe 11 (the spacing between these is on the order to several millimeters to ten millimeters, by way of example), closing the shutter 35 when the probe 11 is lowered and interrupting the spraying of the solvent vapor toward the probe 11, as illustrated in FIG. 3.

In the foregoing embodiment, the solvent is heated to produce the vapor thereof. However, a mist-like solvent may be produced by an atomizer or the like and this may be sprayed toward the probe.

In the foregoing embodiment, the sample stage 21 is moved in the XY directions. However, the probe 11 may be moved in the XY directions. Further, in the time chart shown in FIG. 4, it goes without saying that control may be exercised so as to lower the probe 11 the amount of the depth Z3 instead of raising the sample after the probe 11 contacts the sample surface.

Furthermore, a laser unit (a YAG laser, for example) can be provided and arranged in such a manner that the laser emission direction points in the direction of the tip of probe 11. It is preferred that the laser unit also be supported so as to be freely adjustable in position along the XY directions and Z direction.

The probe 11 at the position of the top end point is irradiated by laser unit 16 from the side direction with, e.g., YAG laser light (frequency-doubled) having a wavelength of 532 nm. With the probe 11 at the position (the position of the top end point) where it has been raised to the uppermost portion, the position is adjusted in such a manner that the irradiation with the laser beam will be performed within several microns from the vicinity of the tip of probe 11. A surface plasmon is induced on the metal (probe 11) surface irradiated with the laser beam. The surface plasmon propagates along the surface of the probe 11 toward the tip and the electric field strength in the vicinity of the probe tip is intensified by several orders of magnitude. Further, in case of irradiation with infrared laser light, the probe surface moistened by the sample is heated rapidly and the desorption of the captured sample is promoted owing to the effect of heating. Further, owing to heating by the infrared laser, it is also possible to observe selective dissociation into the subunits of a biological sample, such as non-covalent-bonded compounds. The probe tip is not irradiated directly with the infrared laser beam; rather, the neighborhood spaced away from the probe tip (e.g., slightly below the tip) is irradiated. As a result, a charged droplet sprayed from the probe tip can be heated. Such heating can promote the vaporization of the ions in the charged droplet into the gaseous phase and can strengthen the ion signal.

Figure 7:
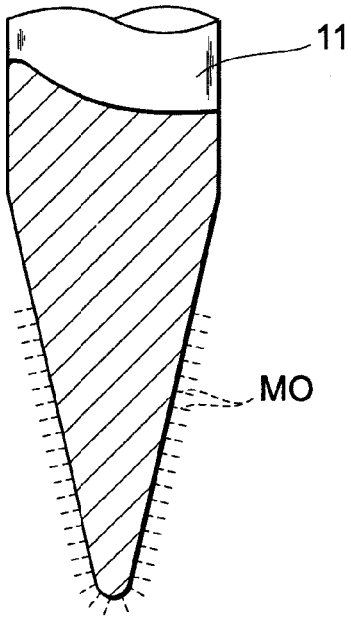
FIG. 7 illustrates the manner in which a probe tip has been chemically modified.

In order to selectively capture a specific molecule (e.g., a cancer marker molecule or the like) on the probe from within a sample, the surface of the tip of the probe 11 should be chemically modified by molecules MO, which capture the desired molecules (compound), before the sample is captured, as illustrated in FIG. 7.

As molecules that chemically modify the probe surface, $—(CH_{12})_{17}—CH_3$ or the like is available as a hydrophobic-group modifying molecule and $—(CH_2)_{10}—NH_2$, $—(CH_2)_{10}—COOH$, etc., are available as hydrophilic-group modifying molecules. By chemically modifying an antibody that bonds with a specific antigen, it is also possible to search for a cancer marker (antigen).

Thus, the surface of the probe (a metal) can be chemically modified by molecules having various functional groups and can be afforded a unique affinity for a certain specific molecule, and this can be brought into contact with a biological sample or the like so that the specific molecule in the sample can be captured selectively at the probe tip.

Use can be made of a probe having a structure in which only the tip portion of the probe is exposed and the upper portion thereof is covered with a polymeric film such as Teflon so that the sample is captured only on the tip portion of the probe.

Second Embodiment

Figure 8:
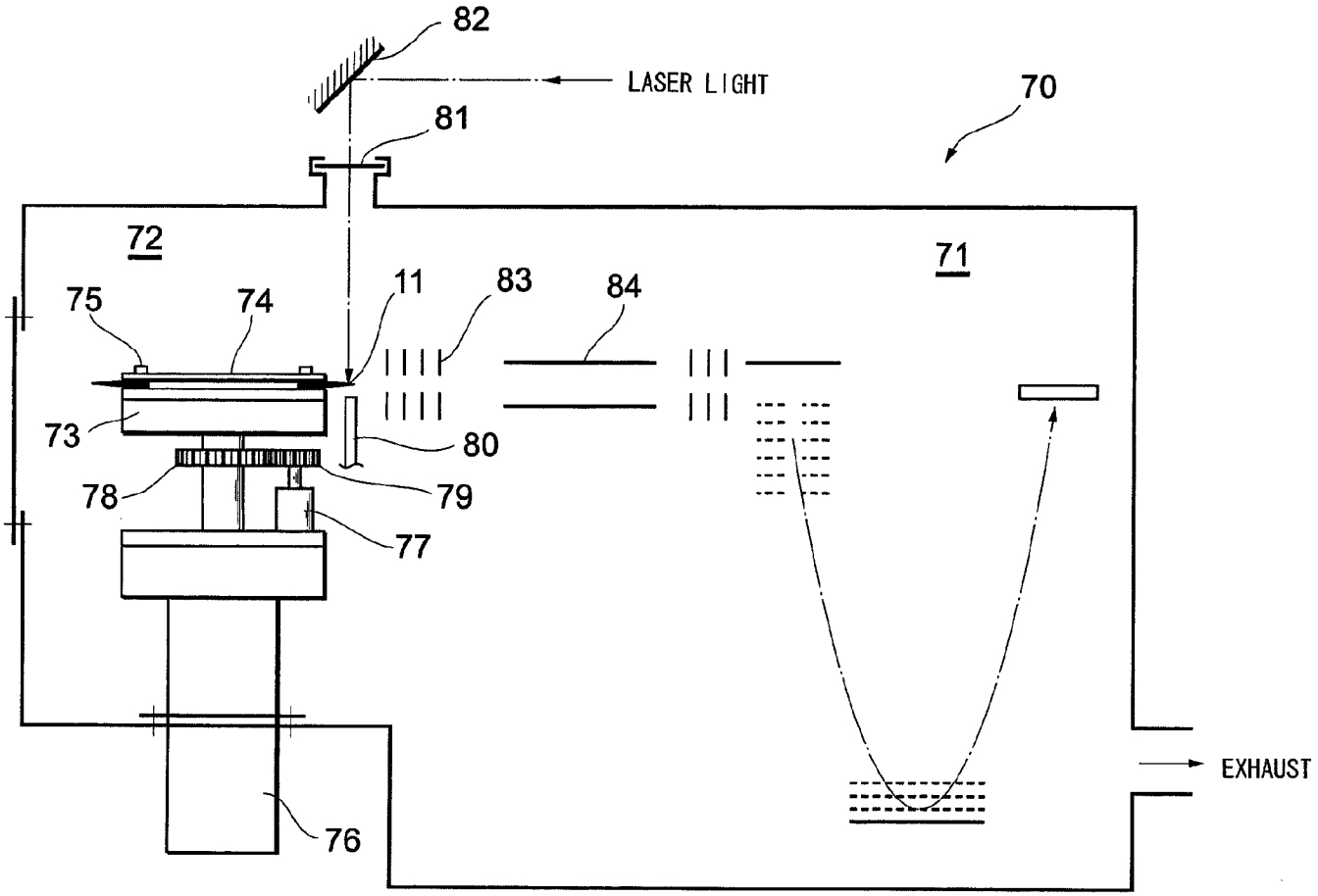
FIG. 8 illustrates the configuration of an ionization analyzing apparatus according to a second embodiment.

FIG. 8 illustrates the configuration of an ionization analyzing apparatus according to a second embodiment. This apparatus is obtained by integrating an ionization apparatus and a mass spectrometry apparatus (orthogonal time-of-flight mass spectrometry apparatus).

An ionization analyzing apparatus 70 comprises a mass spectrometry unit (section) (orthogonal time-of-flight mass spectrometry unit) 71 and an ionization unit (section) 72, and the interior thereof is held in vacuum.

The ionization unit 72 is provided with a stage 73 for both holding and cooling the probe. The stage 73 is held freely rotatably on a helium-circulating cooling device or other cooling unit 76 via a rotary shaft and is cooled to a prescribed temperature by the cooling unit 76. The rotary shaft of the stage 73 is rotated by a motor 77, which is provided on the cooling unit 76 via thermal insulation, through a speed-reduction mechanism that relies upon gears 78, 79 and the like.

Figure 9:
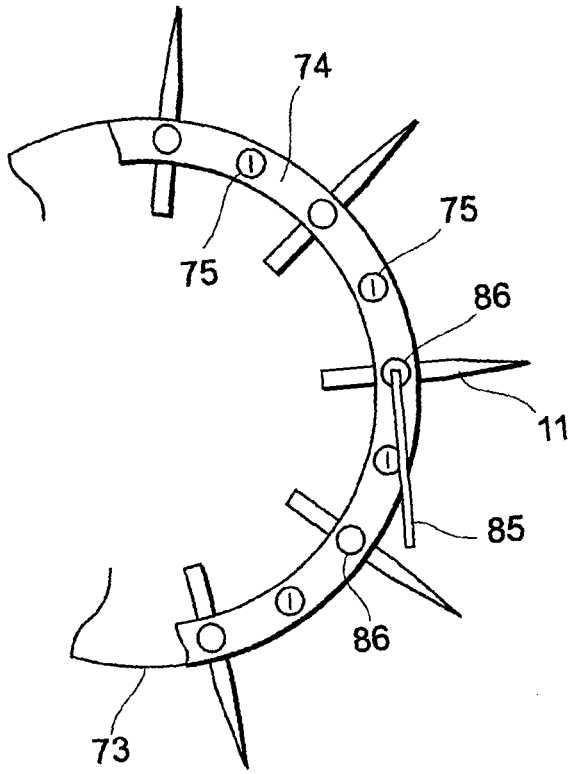
FIG. 9 is a partially cut-away plan view illustrating the mounted state of a probe in FIG. 8.

A number of probes 11 are capable of being placed on the stage 73 in a horizontally radiating fashion centered on the rotary shaft of the stage 73. The probes 11 are restrained, secured and held by a ring 74 fixed to the stage 73 by screws 75 (see FIG. 9). An insulator (not shown) is provided at least on portions of the surface of stage 73 that hold the probes 11. The ring 74 also is an insulator. An electrically conductive contactor 86 screwed fast into the ring 74 is in contact with each probe 11.

Laser light from a laser unit (not shown) is reflected by a mirror 82 (and is gathered by an optical system if necessary) and is introduced into the apparatus 70 through a window 81. The tip portion of one probe 11 held on the stage 73 (this probe is at a position closest to an ion converging lens 83 and points in the direction of the mass spectrometry unit 71) is irradiated with the laser light.

A capillary 80 for introducing a solvent gas and spraying it is arranged in the vicinity of the tip of the probe 11 at the position irradiated with the laser light. A slider 85 for applying a DC high voltage contacts the contactor 86, which contacts the probe 11 at this position, and a DC high voltage for electrospray is applied to the probe 11.

An operator captures a sample (a biological sample) at the tip of the probe 11 under atmospheric pressure in the same way as in the foregoing embodiment using the ionization apparatus shown in FIG. 1 or another apparatus or by a manual operation without using an apparatus.

The probe 11 that has captured the sample at its tip is placed inside the ionization analyzing apparatus 70 shown in FIG. 8 and is secured on the stage 73. Probes that have captured a number of samples can be set on the stage 73.

The interior of the ionization analyzing apparatus 70 is evacuated and the cooling unit 76 is activated to cool the probe 11 (and the sample that has been captured) (to −200° C., for example). The cooling temperature can be set at will.

The solvent gas (steam, alcohol, acetic acid, trifluoroacetic acid or a mixture of these gases) is sprayed from the capillary 80 toward the tip of the cooled probe 11 and is vapor-deposited (adsorbed and captured) on the tip of the probe 11. That is, a thinly adsorbed thin-film layer of the solvent is formed on the surface of the sample that has been captured on the probe 11. If a high voltage is applied to the probe 11 when the solvent gas is adsorbed, it becomes easier to adsorb the gas selectively on the tip portion of the probe where a high electric field is being produced. The adsorption of the gas onto the probe tip can be promoted by utilizing this effect. The solvent gas may be adsorbed in the vicinity of the probe tip without applying a high voltage to the probe.

The solvent gas that has been adsorbed on the probe 11 permeates the biological sample that has been captured on the probe (metal) surface and increases the fluidity of the biological sample. A DC high electric field is produced at the tip of the probe 11 when a DC high voltage (several to several tens of kilovolts) for electrospray is applied to the probe 11 under these conditions. Owing to the fact that the adsorbed gas moistens the sample, the sample develops fluidity, the sample in the liquid state is transported toward the probe tip by the action of the high electric field and electrospray is produced from the tip. Molecules inside the sample are ionized by the electrospray. The ions are sent to the mass spectrometry unit 71 through the ion converging lens 83 and an ion guide 84 and are measured. That is, a mass spectrum of the sample ions is obtained. Since electrospray is carried out in a vacuum, the efficiency with which ions are transported toward the mass spectrometer is raised by a factor of 1000, and this leads to higher sensitivity.

For the purpose of increasing the fluidity of the (biological) sample by adsorption of gas owing to spraying of the solvent gas and in order to assist the desorption of the sample, irradiation is carried out with infrared laser light (10.6 μm), ultraviolet laser light [337 nm (a nitrogen laser) or 355-nm (YAG frequency-tripled) or 532-nm (YAG frequency-doubled) visible pulsed-laser light in a state in which a DC high voltage is applied to the cooled probe 11, and the sample that has been captured at the tip of the probe 11 is desorbed and ionized. The adsorbed or frozen solvent solid is fused and increased in fluidity by irradiation with infrared laser light (oscillatory excitation of the solvent molecules) or by irradiation with ultraviolet or visible laser light (surface plasmon excitation of metal: the state of the molecule electrons is excited), the sample molecules that have been captured at the probe tip are transported to the probe tip while they are dissolved and the molecules are ionized by the electrospray phenomenon at the probe tip and are desorbed (sprayed) toward the vacuum. An additional effect is that the desorption and ionization of the sample are promoted by plasmons excited on the metal surface irradiated with the laser.

When water, alcohol or an acid is used as the solvent molecules, ionization (protonation) of biological molecules, etc., can be promoted. Irradiation with 532-nm visible laser light can be used concurrently. As a result, surface plasmons are produced on the metal surface and desorption of the captured sample is facilitated.

A number of probes 11 can be held on the stage 73. If the stage 73 is rotated and the probes 11 are brought to the laser-light irradiation position (the high-voltage application position) successively, therefore, then many samples that have been captured on these probes 11 can be analyzed successively.

In all of the above-described embodiments, the probe material basically should employ a metal or a semiconductor such as silicon. In case of irradiation with infrared light, it is preferred that the probe be made of gold or Pt/Ir, etc., which readily reflects infrared rays, but tungsten or SUS, etc., is also acceptable; the material does not matter. Further, the probe may be of any shape that is capable of capturing a miniscule amount of sample on its tip. This includes all shapes that make sample capture possible, such as a simple straight-type probe, forceps-type and threaded type probe.

In accordance with all of the above-described embodiments, it is possible to perform nm-order imaging of organisms such as cells having a size on the μm order. In an operation under atmospheric pressure, living cells and the like can be targeted. Since the amount of sample captured on the probe tip is less than a picoliter (pL), living cells and biological tissue can be measured and observed with little invasiveness.

In all of the above-described embodiments, fragmentation does not occur because sample molecules are desorbed and ionized by electrospray and sample molecule ions are not subjected to excessive energy. The embodiments are extremely soft ionization methods.

Biological samples contain much salt and there are instances where they are difficult to deal with in that they do not readily lend themselves to production of a spray by an electric field. In accordance with the first and second embodiments, however, by spraying or vapor-depositing methanol, for example, on the probe under atmospheric pressure or in vacuum, only biological molecules will be dissolved selectively by the methanol and converted to spray ions. Since salt is not dissolved by methanol, it will not be sprayed and will not have a deleterious effect upon the sample spray.

In an operation in vacuum in the second embodiment, substantially the full amount of generated ions can be introduced to the detection system of the mass spectrometer and measured since desorption and ionization take place in vacuum. This means that a high detectability is assured. In particular, when the apparatus of the second embodiment is employed, a large number of probes can be used and samples can be captured at multiple points. Since these numerous probes can be applied to analysis continuously, high-throughput processing is possible.

Other Embodiments

Figure 10:
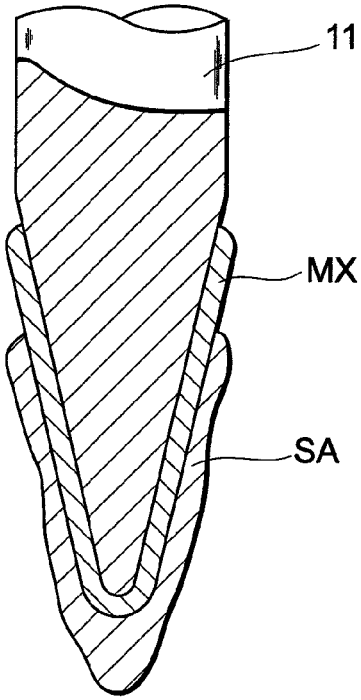
FIG. 10 illustrates the manner in which a sample has been captured at a probe tip following the coating thereof with a matrix.

As illustrated in FIG. 10, the surface of the tip of the electrically conductive (metal) probe 11 is thinly coated with a MALDI (Matrix-Assisted Laser Desorption Ionization) matrix MX. For example, an operation is performed in which the probe 11 is immersed in a solution obtained by dissolving the matrix, thereby wetting the probe surface, withdrawn from the solution and then dried. The thickness of the matrix preferably is less than several microns. Application of the matrix can be performed under atmospheric pressure.

Next, the tip of the probe 11 coated with the matrix MX is brought into contact with a sample (a biological sample) SA under atmospheric pressure and the sample SA is captured at the tip. The tip of the probe 11 is then irradiated with laser light of a wavelength having a band absorbed by the matrix, thereby desorbing the matrix. At this time a DC high voltage is applied to the probe 11 (across the probe 11 and the ion sampling skimmer or capillary). Although it is preferred that the laser light be infrared laser light of 10.6 μm or ultraviolet laser light of 337 nm that exhibits high absorption by the matrix, the wavelength does not matter so long as it is absorbed by the matrix.

When the tip of the probe 11 to which the DC high voltage is being applied is irradiated with the laser, the matrix MX attains the fused state, dissolving/mixing with the sample occurs and a spray obtained by combining matrix-assisted laser desorption ionization and electrospray is produced from the tip of the probe. As a result, highly efficient ionization and desorption of the sample occur simultaneously. This operation may be carried out either under atmospheric pressure or in vacuum. The ions produced are introduced into, and analyzed by, the mass spectroscopy apparatus by the ion sampling skimmer or capillary, etc.

In the embodiment in which the surface of the tip of probe 11 is coated with a MALDI matrix, the ionization apparatus and ionization analyzing apparatus shown in FIG. 1 can be used. However, since spraying of the solvent vapor is not necessarily required, the heating capillary unit 31 may be omitted.

Available as yet another embodiment are an ionization apparatus and ionization analyzing apparatus in which the heating capillary unit 31, feed pump 42 and current control circuit 43 are removed from the arrangement of FIG. 1 and no solvent is supplied. The characterizing feature of this apparatus is that a DC high voltage is impressed across the probe and the ion introduction path of the analyzing apparatus at all times (during the measurement or analysis operation). This simplifies control of application of the high voltage. By bringing the probe into contact with the sample, the probe and sample attain the same potential at least while the probe is in contact with the sample. This means that an operation or means for positively establishing the same potential need not necessarily be devised (the sample may be allowed to float electrically). When the probe separates from the sample and approaches the ion introduction port (ion introduction path), the electric field due to application of voltage across the probe and ion introduction path strengthens and electrospray is produced from the probe toward the ion introduction path. In this case the tip of the probe can be made to approach very close to (e.g., to within several millimeters from) the end of the ion introduction path. The sample ions produced by electrospray can be introduced into the mass analyzing apparatus efficiently.

The invention claimed is:

1. An ionization method comprising:

bringing a tip of an electrically conductive probe into contact with a sample on a stage and capturing a portion of the sample;

subsequently moving said probe in a direction in which it separates from the sample on said stage; and supplying a vapor of a heated solvent to the tip of said probe that has captured the portion of the sample and separated from the sample on said stage, and applying a high-voltage for electrospray to said probe, thereby ionizing molecules of the sample at the tip of said probe.

2. An ionization method according to claim 1, wherein said probe is made to approach in the direction of the sample, said probe is brought into contact with the sample surface and is made to penetrate a prescribed depth into the sample where said probe contacted the sample surface.

3. An ionization method according to claim 1, wherein a surface of said probe tip is chemically modified by molecules that capture a desired compound before the sample is captured.

4. An ionization method according to claim 1, wherein a vicinity of the tip of said probe at a position separated from the sample is irradiated with laser light to thereby promote ionization of the sample.

5. An ionization analyzing method of analyzing molecules that have been ionized by the ionization method set forth in claim 1.

6. An ionization apparatus comprising:

a probe;

a sample stage for holding a sample;

a displacing unit for moving at least one of the probe and sample stage in a direction in which these approach and separate from each other;

a power supply unit for applying a high voltage to the probe at a position where at least a tip of the probe is spaced away from the sample stage; and a solvent supply unit for supplying a vapor of a solvent heated by a heating unit to the tip of the probe at a position where at least the tip of the probe is spaced away from the sample stage.

7. An ionization apparatus according to claim 6, further comprising a contact detecting unit for detecting that the probe tip has contacted a surface of the sample on the sample stage;

wherein said displacing unit causes the probe to approach relatively in the direction of the sample stage and, when the fact that the probe tip has contacted the surface of the sample on the stage is detected by said contact detecting unit, displaces the probe from the detected position so as to cause the probe to penetrate a prescribed depth into the sample.

8. An ionization analysis apparatus having the ionization apparatus set forth in claim 6 and an analytical apparatus for analyzing ionized molecules.

9. An ionization method comprising:

bringing a tip of an electrically conductive probe into contact with a sample and capturing a portion of the sample;

subsequently cooling in vacuo at least the tip portion of said probe, which has captured the portion of the sample; and spraying a solvent vapor heated by a heating unit toward the cooled tip of said probe and applying a high voltage for electrospray to said probe, thereby ionizing molecules of the sample at the tip of said probe.

10. An ionization analyzing method of analyzing molecules that have been ionized by the ionization method set forth in claim 9.

11. An ionization method comprising:

coating a surface of a tip of an electrically conductive probe with a matrix;

bringing said probe tip coated with the matrix into contact with a sample and capturing the sample; and irradiating the tip of said probe, which has captured the sample, with laser light of a wavelength absorbed by said matrix and applying a high voltage for electrospray to said probe to thereby desorb and ionize molecules of the sample at the tip of said probe.

12. An ionization analyzing method of analyzing molecules that have been ionized by the ionization method set forth in claim 11.

13. An ionization method comprising:

causing a tip of an electrically conductive probe to approach in the direction of a sample on a stage, bringing said probe tip into contact with a sample surface, causing said probe tip to penetrate a prescribed depth into the sample where said probe tip contacted the sample surface and capturing a portion of the sample on the stage;

subsequently moving said probe in a direction in which it separates from the sample on said stage; and supplying a solvent vapor heated by a heating unit to the tip of said probe that has captured the portion of the sample and separated from the sample on said stage, and applying a high-voltage for electrospray to said probe, thereby ionizing molecules of the sample at the tip of said probe.

14. An ionization analyzing method of analyzing molecules that have been ionized by the ionization method set forth in claim 13.

15. An ionization apparatus comprising:

a probe;

a sample stage for holding a sample;

a displacing unit for moving at least one of the probe and sample stage in a direction in which these approach and separate from each other;

a power supply unit for applying a high voltage to the probe at a position where at least a tip of the probe is spaced away from the sample stage;

a solvent supply unit for supplying a solvent to the tip of the probe at a position where at least the tip of the probe is spaced away from the sample stage; and a contact detecting unit for detecting that the probe tip has contacted a surface of the sample on the sample stage;

wherein said displacing unit causes the probe to approach relatively in the direction of the sample stage and, when the fact that the probe tip has contacted the surface of the sample on the stage is detected by said contact detecting unit, displaces the probe from the detected position so as to cause the probe to penetrate a prescribed depth into the sample.

16. An ionization analysis apparatus having the ionization apparatus set forth in claim 15 and an analytical apparatus for analyzing ionized molecules.

17. An ionization method comprising:

causing a tip of an electrically conductive probe to approach in the direction of a sample on a stage, bringing said probe tip into contact with a sample surface, causing said probe tip to penetrate a prescribed depth into the sample where said probe tip contacted the sample surface and capturing a portion of the sample on the stage;

subsequently moving said probe in a direction in which it separates from the sample on said stage; and supplying a solvent vapor heated by a heating unit to the tip of said probe that has captured the portion of the sample and separated from the sample on said stage, and applying a high voltage for electrospray to said probe, thereby ionizing molecules of the sample at the tip of said probe.

18. An ionization analyzing method of analyzing molecules that have been ionized by the ionization method set forth in claim 17.

19. An ionization apparatus comprising:

a probe;

a sample stage for holding a sample;

a displacing unit for moving at least one of the probe and sample stage in a direction in which these approach and separate from each other;

a power supply unit for applying a high voltage to the probe at a position where at least a tip of the probe is spaced away from the sample stage; and a contact detecting unit for detecting that the probe tip has contacted a surface of the sample on the sample stage;

wherein said displacing unit causes the probe to approach relatively in the direction of the sample stage and, when the fact that the probe tip has contacted the surface of the sample on the stage is detected by said contact detecting unit, displaces the probe from the detected position so as to cause the probe to penetrate a prescribed depth into the sample.

20. An ionization analysis apparatus having the ionization apparatus set forth in claim 19 and an analytical apparatus for analyzing ionized molecules.

* * * * *